United States Patent [19]

Robison

[11] Patent Number: 4,966,372

[45] Date of Patent: Oct. 30, 1990

[54] BOARD GAME APPARATUS AND METHOD OF PLAYING THE GAME

[76] Inventor: James C. Robison, 550 Franklin Ave., Sellersville, Pa. 18960

[21] Appl. No.: 284,418

[22] Filed: Dec. 14, 1988

Related U.S. Application Data

[63] Continuation-in-part of Ser. No. 66,252, Jun. 25, 1987, abandoned.

[51] Int. Cl.[5] ..... A63F 3/04

[52] U.S. Cl. ..... 273/252; 273/288

[58] Field of Search ..... 273/248–254, 273/246, 1 R, 288

[56] References Cited

U.S. PATENT DOCUMENTS

| | | | |
|---|---|---|---|
| 476,146 | 5/1892 | Hunersdorff | 273/251 |
| 3,891,209 | 6/1975 | Kritzberg | 273/1 R |
| 4,082,284 | 4/1978 | Jennings | 273/251 |
| 4,134,591 | 1/1979 | Brooks | 273/252 |
| 4,377,287 | 3/1983 | Erwin | 273/252 |

*Primary Examiner*—Benjamin Layno

*Attorney, Agent, or Firm*—Joseph W. Molasky & Assocs.

[57] ABSTRACT

A game of chance which entertains and educates by providing information on early American history, particularly the Western territories and personages associated therewith. Trails, reduced to a game board size, are sequentially traversed with figurine game pieces used as markers which impart historical perspective to the players. The players select certain trails and an associated figurine whose persona is assumed to enhance the enjoyment and educational aspect of the game. Action cards provide instructions in the form of rewards or penalties for moving the game pieces and furnish the participants with historical information which is germane to the era in which the events occurred. Certain instructions require a player to recite an imaginative story.

16 Claims, 5 Drawing Sheets

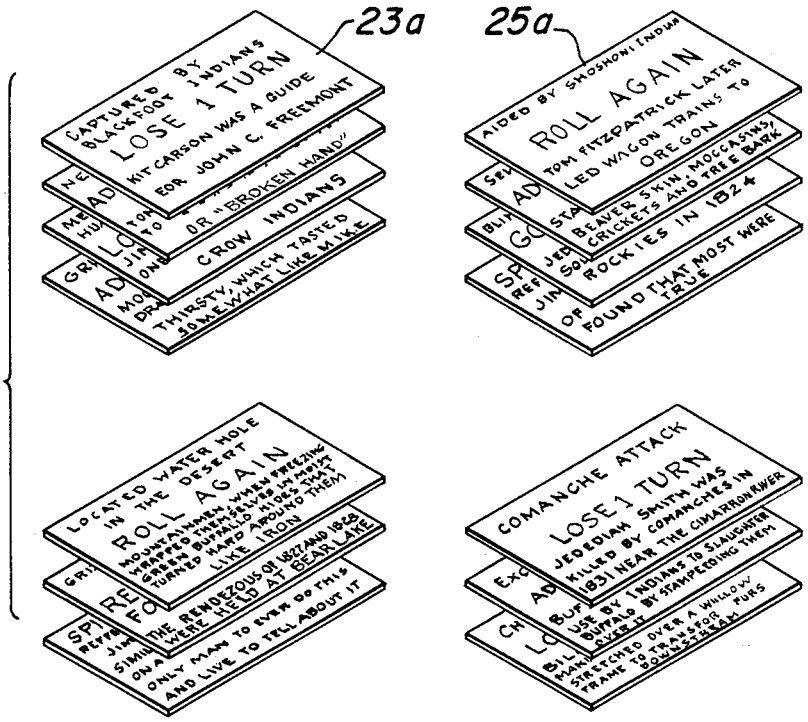
FIG. 3
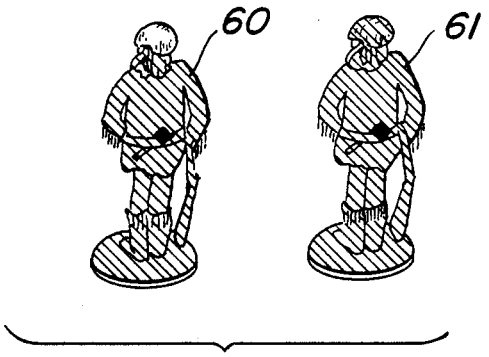
FIG. 4
FIG. 5
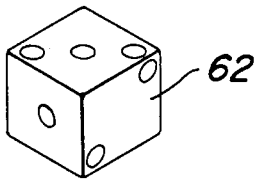

BOARD GAME APPARATUS AND METHOD OF PLAYING THE GAME

This application is a Continuation-in-Part of applicant's copending Ser. No. 066,252, filed June 25, 1987 now abandoned.

BACKGROUND OF THE INVENTION

1. Field of the Invention

This invention pertains to a game apparatus which presents educational material to participating players in an amusing, stimulating and thought-provoking manner. Specifically, the apparatus of this invention is designed to provide an educational experience on the development, expansion and exploration of the United States' Western territories and it has particular application as a teacher's aid because it provides a novel means for arousing and maintaining interest in a subject which some students regard as tedious.

2. DESCRIPTION OF THE PRIOR ART

Games that entertain and educate are known for a variety of subjects as, for example, the game of finance covered by U.S. Pat. No. 2,693,961. However, there are no such known games available in the field of United States history and, specifically, that time period which is associated with the development of the Western territories.

SUMMARY OF THE INVENTION

The educational game board of the present invention focuses on exploration and travel within the Western territory of the United States by early settlers. The area covered includes at least three circuitous and segmented trails equipped with starting points and turnabout sites. The object of this game is to be first in traversing a selected trail from the start position to a turnabout site following which the player returns to the start via the same route.

A player advances along a plurality of segments or spaces on a chosen trail in accordance with a number rolled on a die. Progress along the trail is noted by use of different figurine markers representing certain historical explorers associated with a particular trail, and the players immerse themselves into the identity of the personage represented by the markers in order to enhance ones' enjoyment vicariously. Randomly located along the trail are certain designated spaces which, when landed upon, require that an Action Card be selected from one of two stacks. The Action Card rewards or penalizes the player by providing instructions which require him to advance or back-track several spaces. Other Action Cards require that participants tell a "Tall Tale", after which truthfulness is determined by a rolling of the die. Rewards and penalties are also presented by providing cut-offs, by-passes and rendezvous locations which impede or enhance the player's opportunity to traverse the trail en route to a turnabout site. The entertaining aspects of the game result from the chances which are taken by the players, whereas, educational information is imparted by exposing the players to historical facts and information bearing on the territory that early pioneers traversed in opening up the Western territories.

Accordingly, a new game of chance has been devised whose main objects are to entertain by using the laws of probability and, also to educate by exposing the players to historical facts and circumstances.

DETAILED DESCRIPTION OF THE DRAWINGS

FIG. 3 is a perspective view of two groups of Action Cards in a stacked formation.

FIG. 4 is a view of a historical figurine which is used as a marker in the present game invention.

FIG. 5 is a prospective view of a die as used in the invention.

DETAILED DESCRIPTION OF THE INVENTION

Figure 1:
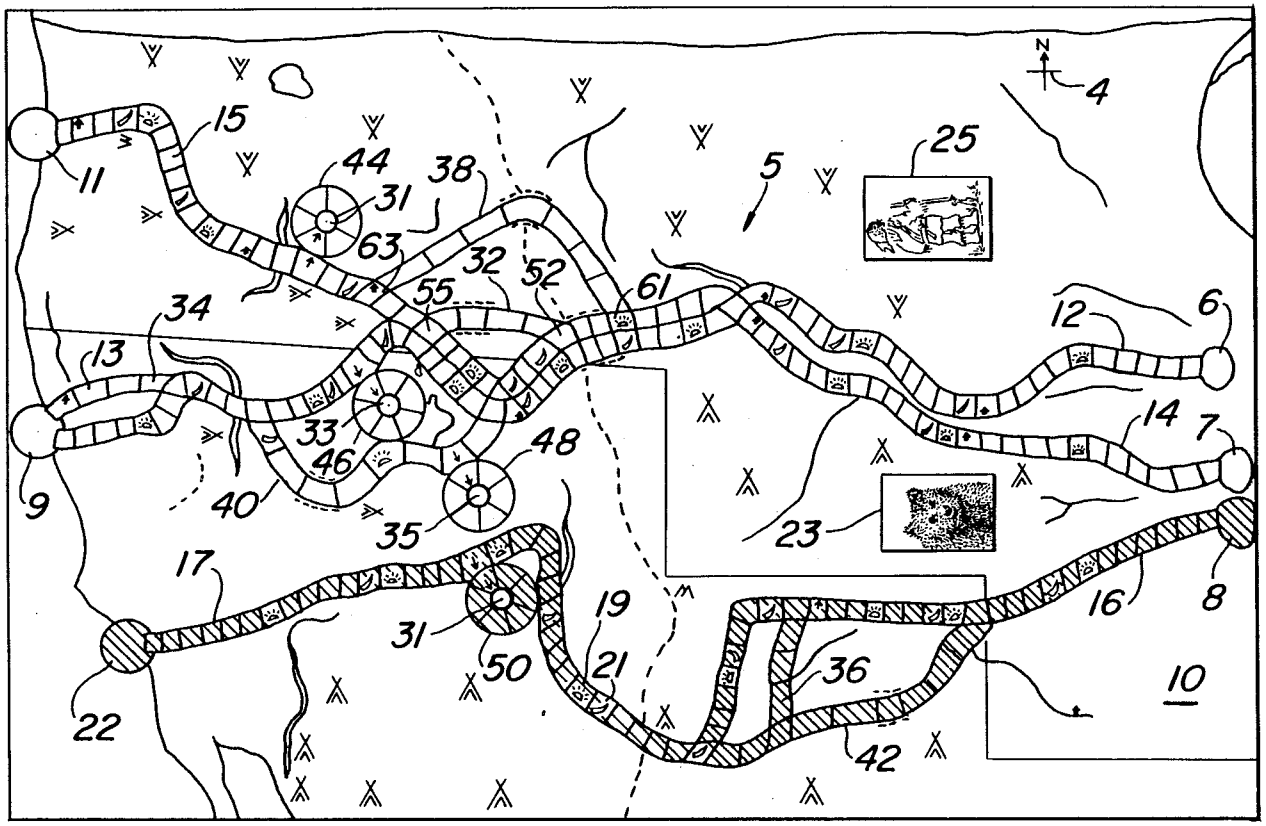
FIG. 1 shows a perspective view of a game board in which various trails followed by early pioneers of the Western territory of the United States is depicted.

Referring now to FIG. 1 in detail, there is depicted a board 10 comprising the subject game invention which depicts three historical trails 12, 14, 16, circuitously passing over a territory 5 which covers partially explored mid-western and western territories of the United States. In addition to the board 10, the game comprises marker pieces in the form of representative figurines 60, 61 (FIG. 4) of which there are six in number and distinguishable from one another, ten grizzly bear cards **23*a* (FIG. 3), ten mountainman cards 25*a* and one die 62 (FIG. 5). The six figurines are divided into three sets where one set is required to be utilized with each trail. The set, for example, illustrated in FIG. 4 is colored with the same hue as is the color of the trail on which it is to be used. The two figurines of a set are further distinguished from one another by providing different colored hats for each. The reason for these distinctions will be discussed in paragraphs hereinbelow. The game can be played by two to six players but not more than two players may use the same trail 12, 14 and 16. The game is initiated by having a player select one of the trails 12, 14, 16 that is desired to be traversed and a mountainman figurine 60 of the same color and moving towards any one of the West Coast locations 9, 11, 22 beginning from start point 6, 7, 8. While the player is traversing the trail 12, 14, 16, it is intended that historical as well as geographical material will be presented in an accurate yet amusing manner. The territory 5 and trails 12, 14, 16, which are reduced to a game board size, are historically significant since they focus upon and pertain to a time frame between the years 1825 and 1845 wherein the United States was still in its formative stages. This time span encompasses a promulgation of the Treaty of 1818 between the United States and Great Britain after the War of 1812. The Treaty of 1818 provided a line of demarcation between the United States and British possessions, which is now known as Canada, and is delineated on the territory 5 in its upper northern limits as viewed by compass symbol 4. The time frame 1825–1845 also included an enactment of the Treaty of 1819 between Spain and the United States which settled certain territorial claims between the two countries, and is also delineated on the game board 10. The trails 12, 14 and 16 are each divided into an equal number of segments 13, 15, 17 as they respectively span outer limits of the game board 10** from the Pacific Ocean on the left to the Midwest as represented by the states of Missouri, Iowa and Wisconsin on the right.

Figure 2A:
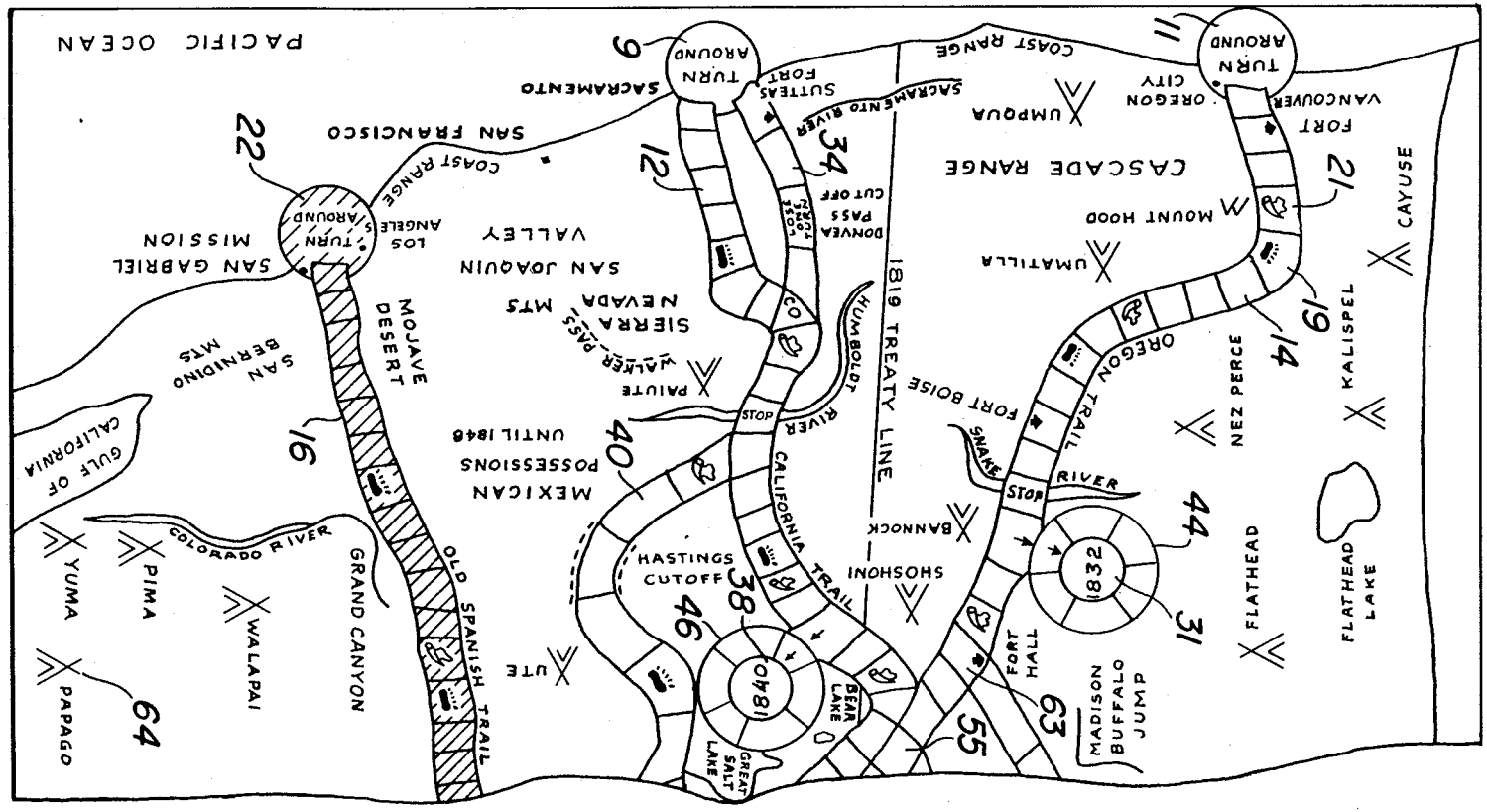
FIG. 2A is a detailed view of a section approximating one-third of the territory of FIG. 1.
Figure 2B:
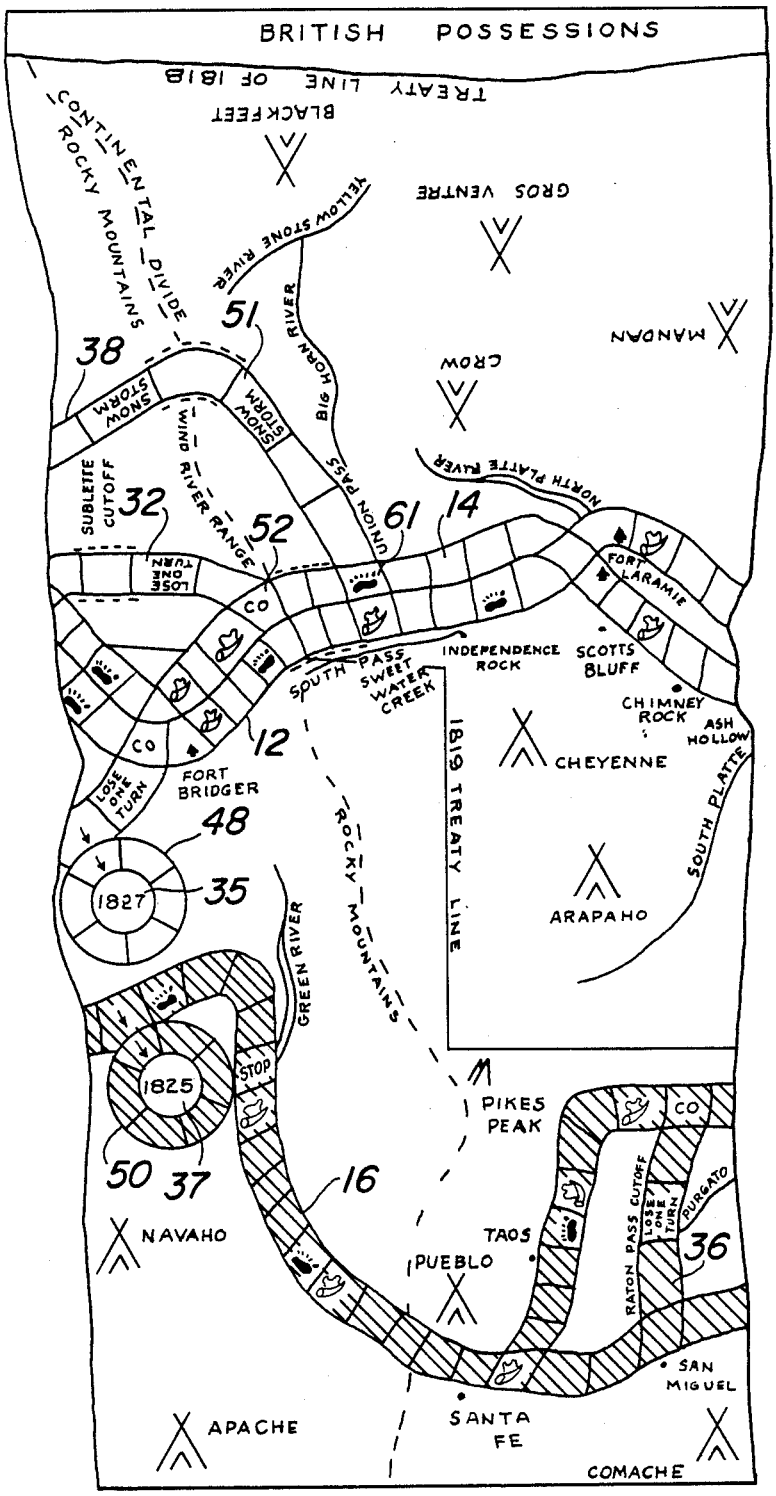
FIG. 2B is a further detailed view of a section approximating another one-third of the territory of FIG. 1 and for juxtaposing with the view of FIG. 2A.
Figure 2C:
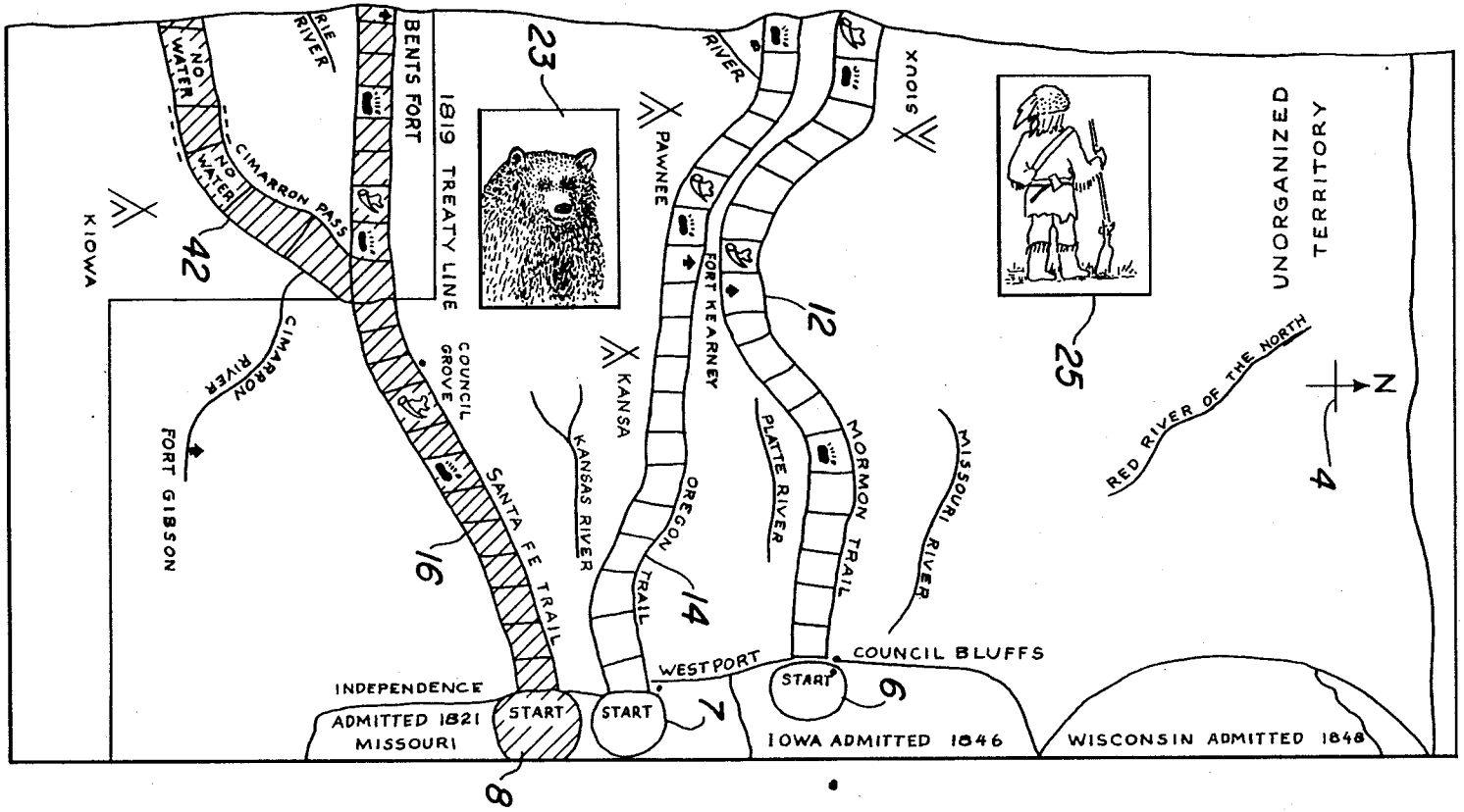
FIG. 2C is still a further detailed view of a section approximating still another one-third of the territory of FIG. 1 and for juxtaposing with the view of FIG. 2B.

The trails 12, 14, 16, which are respectively identified as Mormon, Oregon and Santa Fe, are intended to substantially duplicate the actual routes as they occurred in historical times. Each trail 12, 14, 16, respectively, has at each extremity the start point 6, 7, 8 as well as a turnabout site 9, 11, 22 and the object of the game is to be first in traversing a selected trail from the start point to the turnabout site and back to start. It should be noted that the Mormon Trail 12 becomes the California Trail at Great Salt Lake (FIGS. 2A, 2C), whereas, the Santa Fe trail 16 becomes the Old Spanish Trail at the town of Santa Fe (FIGS. 2A, 2B). The figurine markers 60, 61, which are six in number, impart historical perspective and represent early mountainmen such as Kit Carson, Jed Smith, Jim Beckwourth, Jim Bridger, Joseph Walker and Tom Fitzpatrick. As mentioned previously, the typical markers 60, 61 allow the players to conveniently note and identify their position as they advance or regress on segments 13, 15, 17 on the respective trails 12, 14, 16. The markers 60, 61 when representing Kit Carson and Jed Smith are used on the Santa Fe trail 16 whereas Jim Beckwourth and Joseph Walker are utilized on the Mormon Trail 12 and Jim Bridger and Tom Fitzpatrick on the Oregon Trail 14. The particular marker set is assigned to a trail because these personalties performed their exploits in its surroundings. In order to ascertain the set of marker personalities with the appropriate trail the color applied to the set and trail will be the same; therefore, the Oregon trail and its markers are colored orange, the Santa Fe trail and its markers colored green and the Mormon trail and its markers colored brown. The coloring of the markers 60, 61 (see FIG. 4) when representing Kit Carson and Jed Smith are shown by the shading representing the color green and the same shading is depicted along the Santa Fe trail 16. Only one trail is colored and one set of figurines is shown in the drawings for purposes of simplicity. In accordance with the rules, no two players may occupy the same space and if a player lands on a segment 13, 15, 17 which is already occupied the player must move back one space. The nature of the game is such that the participants become absorbed by the unfolding events and they share vicariously in the exploits of the mountainmen personages whose identity or persona they assume as the markers move up and down the trails.

By way of example, players select a trail and a marker associated with the trail and the persona they wish to identify with prior to beginning the game, and, let it be assumed that a player chooses the Santa Fe trail to traverse and the explorer that he wishes to identify with is Kit Carson, who is represented by the figurine 60 with the white hat. As the player moves along the trail he will identify with Carson's adopted home located in Taos (see FIG. 2B) and will experience his exploits as a guide as the player travels from east to west. In addition, the player will vicariously experience Carson's talent as an Indian guide as contacts are made with the various Indian tribes exemplified by the many wigwam symbols 64 (see FIG. 2A) along the Santa Fe trail. As the trail is traversed the player will also identify with Kit Carson's appointment as a lieutenant colonel in the New Mexican Infantry which is in the vicinity of the Santa Fe trail and his demise in the Colorado territory.

The segmented trails 12, 14, 16 are traversed by allowing each player to alternately throw the die 62 (FIG. 5) and move their respective game piece a corresponding number of spaces on segments 13, 15, 17. Randomly positioned on certain segments 13, 15, 17 along the trails 12, 14, 16 are bear paw and powderhorn indicia 19, 21 (FIGS. 1, 2A). The indicia 19, 21 are associated with the respective grizzly bear and mountainman Action Cards **23*a*, 23*b* (FIG. 3), which are stacked in groups of ten in grizzly and mountainman areas 23, 25 (FIGS. 1, 2C) upon the game board 10. The Action Cards 23*a*, 23*b* carry a grizzly bear picture on the reverse side (not shown) and these are stacked in the grizzly bear area 23 of game board 10; whereas, Cards bearing the mountainman on the reverse side (not shown) are stacked in the mountainman area 25. Each Action Card 23*a*, 25*a* has instructions printed thereon which either rewards or penalizes a player. A reward instructs the player to advance a certain number of segments or to roll the die again. For example, if a player lands on the segment 19 in which a bear paw is depicted the player draws a topmost Action Card 23*a* from the card pile on grizzly bear area 23 and follows its printed instruction; similarly, if a player lands upon segment 21 then a topmost Action Card 25*b* of the mountainman group is selected from the pile on area 25. After an Action card 23*a*, 25*a* is selected and acted upon by a player it is returned to the bottom of the stack. In addition to providing instructions each Action Card 23*a*, 25*a* also relates a historical fact which is germane to the time period and territory 5 above mentioned as, for example, that Jedediah Smith was killed by Comanches in 1831 near the Cimarron River. Some of the Action Cards 23*a*, 25*a*** also instruct the player to "tell a tall tale", an event which is discussed in greater detail hereinbelow.

Four cutoffs 32, 34, 36 and 40 (FIGS. 1, 2A, 2B) are positioned along the various trails 12, 14, 16 and are designed to enhance the probability of a player winning over his opponent by shortening the number of segments 13, 15, 17 required to be traversed from the start points 6, 7, 8 to the turnabout sites 9, 11, 22. This is demonstrated on the Oregon Trail 14 where the cut-off 32 (FIG. 1) incorporates four segments to travel from segment 52 to segment 55, whereas, there is an eight unit span between the same segments in using the main trail. However, it is to be observed that in order for a player to use the cut-off 32 the player must land upon segment 52 (i.e., CO, FIG. 2B) after a roll of the die 62. Upon landing upon the segment CO, the player is then required to declare whether he will use the cut-off or use the regular trail 14 prior to his next turn. This prior declaration by the player is necessary because each of the cut-offs 32, 34, 36, 40 include a penalty segment identified as "lose-one-turn". The prior declaration therefore prevents a player from changing strategy by refusing to use the cut-off if the roll of the die 62 would cause him to land on the penalty segment. As may be apparent from the above, the cut-offs 32, 34, 36, 40 are available for use by the players when traveling from the start points 6, 7, 8 to the turnabout sites 9, 11, 22 but cannot be utilized in traversing the trails 12, 14, 16 in the reverse direction. It should be noted that the cut-offs 32, 34, 36, 40 were historically known by the names of Sublette, Donner, Raton and Hastings.

In addition to the cut-offs, 32, 34, 36, 40 two passes 38, 42 (FIGS. 2B, 2C) which are referred to respectively as Union and Cimmaron are also provided along trails 14, 16. The passes 38, 42 provide the same strategic value to the players as that previously described with respect to the cut-offs 32, 34,36, 40. However, a greater number of regular trail segments 13, 15, 17 can be by-passed by the player when using the passes over that of the cut-offs. As may be readily appreciated, the Union Pass 38 (FIGS. 1, 2A, 2B) in traveling from segment 61 to segment 63 requires a distance of seven spaces, whereas, in traveling between the same two segments on the Oregon trail 14 require a distance of fourteen spaces. The player may or may not use the pass 38 if he so chooses, but it should be noted that if a decision is made to use it hazardous segments 51 in the form of a "snow storm" or "no water" (FIG. 2B) are strategically positioned along its route. When a player lands on one of the hazard segments he must turn around and backtrack and go to the main trail 14. The use of the Pass 38 therefore provides a riskier alternative for a player than the use of the cut-off 32 since it has twice the number of hazards. Historically, the Union Pass 38 on the Oregon Trail 14 went through the Rocky Mountains and was often unpassable due to heavy snow. Accordingly, the instant game by an incorporation of the hazards is designed to duplicate conditions as actually existed at the time.

Also, positioned along each trail 12, 14, 16 are rendezvous sites 44, 46, 48, 50. In accordance with the present invention, it is required that each player stop and enter the rendezvous sites when they are encountered in traversing any of the trails 12, 14, 16. The rendezvous sites 44, 46, 48, 50 are designed with a center 31, 33, 35, 37 which are encircled by six segments which are similar to the segments 13, 15, 17 on respective trails 12, 14, 16. The rendezvous centers 31,33,35,37 include a number that identifies a year when the rendezvous occurred at that particular location. During the years between 1825 and 1845 the rendezvous sites 44, 46, 48, 50 were designated by the early mountainman along the various trails as a meeting place in order to share experiences and engage in social contact after their arduous and lonely existence on the trails 12, 14, 16. In the playing of the instant game, a person can only enter the rendezvous sites 31, 33, 35, 37 with an exact roll of the die 62; however, the rendezvous sites must be circled by using its six surrounding segments and the centers 31, 33, 35, 37 then entered on any number if the exact number is not rolled by the player. Once a player is in the rendezvous sites 44, 46, 48, 50 and has entered centers 31, 33, 35, 37 a "one" or a "five" must be rolled with the die 62 during a regular turn in order to depart and continue traversing the respective trails 12, 14, 16.

When the Action Card **23*a*, 25*a* is drawn with instructions to "Spin a Tall Tale", the player must tell an imaginative story about his days traversing the trail 12, 14, 16. Each of the opponents of the player drawing the Action Card 23*a*, 25*a* must also tell a "tall tale" and after each has done so all participants roll the die 62 to determine who has told the truth. The truth is determined by the player rolling the highest number after which a forward movement of five segments 13, 15, 17 is permitted. The following benefits also accrue to a player when a roll of the die 62 determines that the truth has been told after the telling of a "tall tale": a player at a rendezvous 44, 46, 48, 50 may leave and advance five spaces; the player that is near a river may cross without stopping; when a player is near a turnabout site 9, 11, 22 he may enter and then begin a return to the start point 6, 7, 8 in order to finish the game; the player who is closely positioned near a start point 6, 7, 8 may only enter if he is exactly five spaces from the start circle. However, if the player is less than five spaces away from the start circle, the spaces must be forfeited. On the other hand, if he is more than five spaces away from the start circle he may merely move closer thereto. In an event that there is a tie in the roll of the die 62** to determine the truth of the imaginary talc, another roll is required between the players who are tied.

Another feature of the present game invention occurs when a rifle frolic is called for by one of the players. The rifle frolic is a shooting match for fun and is an option which is available when a player is located in the rendezvous sites 44, 46, 48, 50. The rifle frolic may be called for by a player in order to leave the rendezvous site 44, 46, 48, 50 rather than departing by rolling the one or the five with the die 62. When a rifle frolic is called each player rolls the die three times and the total of the three is the score of the match. When a tie occurs in the score the player who tied rolls again to determine the winner. The highest score wins the match and if the player is in the rendezvous sites he may leave and advance five segments 13, 15, 17. If an opponent wins, an advance of five segments is allowed. However, if the player is near a river it may be crossed without stopping; if the player is near the turnabout sites 9, 11, 22 it may be entered and a start back begun. Nevertheless, a player that is near a start point 6, 7, 8 may only enter if he is exactly five spaces from the start circle. However, if the player is less than five spaces away from the start circle, the spaces must be forfeited. On the other hand, if he is more than five spaces away from the start circle, he may merely move closer thereto.

Certain rules of play are also incorporated in the present game invention in order to enhance overall enjoyment by the participants. It will be recalled that no two players may be located on the same segment 13, 15, 17 during the traverse over the trails 12, 14, 16, however, this rule does not apply at a river crossing where two players may occupy a stop segment. An additional rule requires that a turnabout site 9, 11, 22 may be entered with any roll of the die 62. However, with the next roll of the die, the journey is begun back to the start points 6, 7, 8 without using cut-offs 32, 34, 36, 40 and disregarding bear paw and powderhorn indicia 19, 21, rivers and rendezvous sites 44, 46, 48, 50. Another rule of play requires that to finish the game the player must return to the start circle 6, 7, 8 and he must do so only with an exact roll of the die 62, which was briefly alluded to with respect to the use of the rifle frolic. This adds an element of excitement during the play because it enables an opponent who is only a short distance behind the leading player to have an opportunity of finishing first.

The educational aspects of the subject game invention are further enhanced by locating on the game board 10 various Indian Tribe locations such as Navaho, Apache and Sioux by means of a wigwam symbol 64 (FIG. 2A). Geography is also made into an integral learning experience for the persons playing the game by locating rivers, mountains, forts and towns within the territory 11 and in approximate relationship to the trails 12, 14, 16. It is a purpose of the present invention that the participating players will subjectively absorb the associated history and geography as they become engrossed in playing the game.

The game board 10 is shown in the Drawings as a flat planar surface on which are imprinted such topographical features such as the Cascade Range, Continental Divide, Scott's Bluff, Chimney Rock, Independence Rock, Coast Range and Rocky Mountains and the like. Unfortunately, those promontories and the relief features associated with such depressions and water courses as the Joaquin Valley and Humboldt River cannot be expressed on a planar surface; however, it is to be understood that their absence is due solely to the limitations of the Drawings and a contoured board incorporating same is to be considered as equivalent to the former and within the scope of the present invention.

This invention has been described by reference to precise embodiments but it will be appreciated by those skilled in the art that this invention is subject to various modifications and to the extent that those modifications would be obvious to one of ordinary skill they are considered as being within the scope of the appended claims.

What is claimed is:

1. A game apparatus comprising in combination:

(a) a game board which provides at least three differently colored, segmented and circuitous paths which represent exploratory trails across the United States in its formative years;

(b) three sets of figures for use by opposing players of said game where each set is distinguishable by their color and each figurine of a set being further distinguishable by a different colored hat wherein a certain one of said colored figurine sets is used as markers with a correspondingly colored one of said three trails;

(c) each of said figurines representing a different explorer historically connected with said trail, and said respective players identifying themselves with the selected set of explorer in traversing the trail during the playing of the game;

(d) a die means having numerical indicia for alternative casting by said players during the course of said game wherein the number cast allows the player to incrementally traverse a selected trail in accordance with said number;

(e) means for giving a reward or penalty instructions to a player when any one of said markers lands upon any one of two different randomly positioned segments on said trail; and (f) whereby the historic trail is traversed vicariously by said player through the persona of the selected figurine whereby the player becomes educated with respect to the early exploratory history of the United States.

2. The game apparatus in accordance with claim 1 wherein said three sets of figurines represent the explorers Kit Carson, Jed Smith, Jim Beckwourth, Jim Bridger, Joseph Walker and Tom Fitzpatrick.

3. The game apparatus is accordance with claim 2 wherein the figurine set representing Kit Carson and Jed Smith are required to be played on the Sante Fe trail; and, the figurine set representing Jim Beckwourth and Joseph Walker are required to be played on the Mormon trail; and, the figurine set representing Jim Bridger and Tom Fitzpatrick are required to be played on the Oregon trail.

4. The game apparatus in accordance with claim 1 wherein said trails represent the Mormon, Sante Fe and Oregon trails.

5. A method for playing a historical board game which describes by word and picture the westward exploration of the United States, said board having segmented main trails and alternative routes in the form of segmented cut-off trails and segmented passes for shortening said main trails including figurine markers for locating a player's position on said trails, said cut-off trails including penalty segments and said passes including hazard segments such that said cut-offs and passes represent short-cuts, said passes having more hazards than said cut-offs have penalties, including first and second sets of command means which provide instructions in the form of rewards and/or penalties to said players, said method comprising:

(a) a minimum of two and a maximum of six players who compete in said game by rolling a die to provide a number and allow a player to advance a figurine marker a number of segments on one of said main trails;

(b) selecting a figurine marker associated with a certain trail so as to assume the persona of said marker;

(c) allowing a player to optionally select a cut-off trail when a marker lands upon a designated segment;

(d) allowing said player to optionally select a pass route so as to provide a faster advance but also a riskier alternative to said cut-off.

(e) selecting from one of said first and second sets of command means when a player lands upon one of two randomly positioned segments along said main trails;

(f) reciting an imaginative story by all players when certain command means are selected; and (g) rolling a die following the recitation of said story in order to determine if the story is true.

6. The method in accordance with claim 5 wherein the landing upon said designated segment occurs immediately prior to an entrance to said cut-off.

7. The method in accordance with claim 6 wherein the step of using either a cut-off or pass route is determined by whether a player elects to assume the risk inherent in following the latter alternative.

8. The method in accordance with claim 7 wherein the step of using the pass route alternative exposes the player to twice the number of hazards as that of the cut-off option.

9. The method in accordance with claim 8 which further comprises the step of allowing a player to meet at a rendezvous point positioned off the main trail.

10. The method in accordance with claim 9 which further comprises the step of allowing a player to enter the rendezvous point from the main trail only on an exact roll of said die means.

11. The method in accordance with claim 10 and further comprising the step of allowing a player to circle around said rendezvous point in six steps.

12. The method in accordance with claim 11 which further comprises the step of circling said six circular segments with one of said markers prior to entering the center region by casting said die.

13. The method in accordance with claim 12 which further comprises the step of rolling one of two numbers in order to depart the rendezvous point in order to continue traversing upon the main trail.

14. The method in accordance with claim 13 which further comprises the step of calling for a rifle shooting match as an option when a player in a rendezvous point wishes to depart.

15. The method in accordance with claim 14 which further comprises having each player cast the die three times which the total of said castings determining the winner of the rifle shooting match.

16. The method in accordance with claim 15 which further comprises the steps of allowing an opponent to advance five segments if he wins the rifle shooting match; and alternatively, if a player is near a river, he may cross without stopping; and alternatively, if a player is near turnabout sites near the end of a segmented trail it may be entered and traverse of the trail begun in the reverse direction if he wins, and alternatively, if a player is near a starting point at the beginning of a trail he may enter to complete the game only if he is exactly five spaces from the start circle.

* * * * *